US010541501B2

(12) United States Patent
Hutchison et al.

(10) Patent No.: US 10,541,501 B2
(45) Date of Patent: Jan. 21, 2020

(54) APPARATUS FOR PROVIDING POWER FOR MULTIPLE TYPES OF PLUGS VIA A SINGLE RECEPTACLE

(71) Applicant: Vertiv Corporation, Columbus, OH (US)

(72) Inventors: Gordon Hutchison, Rugby (GB); Sam Riley, Over Stowey (GB); Andrew Case, North Petherton (GB); Simon Lewis, Taunton (GB); Brad Wilson, Lincoln, NE (US)

(73) Assignee: Vertiv Corporation, Columbus, OH (US)

( * ) Notice: Subject to any disclaimer, the term of this patent is extended or adjusted under 35 U.S.C. 154(b) by 0 days.

(21) Appl. No.: 16/179,266

(22) Filed: Nov. 2, 2018

(65) Prior Publication Data

US 2019/0140410 A1 May 9, 2019

Related U.S. Application Data

(60) Provisional application No. 62/580,876, filed on Nov. 2, 2017.

(51) Int. Cl.
*H01R 27/00* (2006.01)
*H01R 13/627* (2006.01)
*H01R 25/00* (2006.01)

(52) U.S. Cl.
CPC ..... *H01R 27/00* (2013.01); *H01R 13/6273* (2013.01); *H01R 25/006* (2013.01)

(58) Field of Classification Search
CPC ... H01R 13/6273; H01R 25/006; H01R 27/00
USPC ..... 439/222
See application file for complete search history.

(56) References Cited

U.S. PATENT DOCUMENTS 4,349,176 A 9/1982 Thornton
6,755,680 B2 * 6/2004 Okamura ..... H01R 12/772 439/483
8,052,437 B2 * 11/2011 Jiang ..... H01R 25/003 439/106

(Continued)

FOREIGN PATENT DOCUMENTS

DE 202016101189 U1 3/2016

OTHER PUBLICATIONS

International Search Report and Written Opinion dated Feb. 21, 2019 for PCT/US2018/059031.

*Primary Examiner* — Abdullah A Riyami
*Assistant Examiner* — Vladimir Imas
(74) *Attorney, Agent, or Firm* — Suiter Swantz pc llo

(57) ABSTRACT

The present disclosure is an apparatus for providing a multiple receptacle assembly whereby a number of receptacles could be configured within a single assembly of a standard size. It is contemplated that more receptacles may be available in a particular size and width than conventional power distribution units. Additionally, in another aspect of the present disclosure, the present disclosure is directed to an apparatus for providing power for multiple types of plugs via a single receptacle. In one embodiment of the disclosure, apparatus for providing power for multiple types of plugs via a single receptacle may provide power to one of a C14 plug or a C20 plug via a single receptacle, whereby the single receptacle may be configured to operate as a C13 and C19 receptacle and in compliance with IEC60320 standards.

22 Claims, 15 Drawing Sheets

(56) References Cited

U.S. PATENT DOCUMENTS 8,212,388 B2 * 7/2012 Langgood ..... H01R 13/447 307/29
8,469,730 B2 * 6/2013 Garb ..... H01R 31/065 439/107
8,469,734 B2 * 6/2013 Chen ..... H01R 13/506 439/353
9,054,449 B2 * 6/2015 Utz ..... H01R 13/5812
9,226,414 B2 * 12/2015 Weeks ..... H05K 5/02
9,509,086 B2 * 11/2016 Utz ..... H01R 13/5812
9,531,126 B2 * 12/2016 Krietzman ..... H01R 13/639
9,735,502 B2 * 8/2017 Stevens ..... H01R 13/621
9,837,753 B1 * 12/2017 Chen ..... H01R 24/78
9,843,146 B1 * 12/2017 Chen ..... H01R 13/514
9,991,633 B2 * 6/2018 Robinet ..... H01R 13/6275
10,003,163 B2 * 6/2018 Hewitt ..... H01L 45/04
10,205,281 B2 * 2/2019 Preuss ..... H01R 13/6271
10,297,995 B2 * 5/2019 Weeks ..... H02G 3/081
2002/0022406 A1 2/2002 Hutchison
2004/0077203 A1 4/2004 Dewitt et al.
2008/0076291 A1 3/2008 Ewing et al.
2010/0117453 A1 5/2010 Langgood et al.
2011/0256750 A1 * 10/2011 Chen ..... H01R 13/506 439/345
2013/0095691 A1 4/2013 Blanton
2013/0097812 A1 * 4/2013 Sanders ..... H01R 13/639 24/115 R
2013/0109213 A1 * 5/2013 Chang ..... H01R 13/633 439/304
2013/0143428 A1 * 6/2013 Chang ..... H01R 13/6395 439/357
2013/0157495 A1 * 6/2013 Chang ..... H01R 13/6395 439/345
2013/0244468 A1 * 9/2013 Chang ..... H01R 13/6395 439/345
2015/0044900 A1 * 2/2015 McDowall ..... H01R 13/6275 439/372
2015/0104968 A1 * 4/2015 Hutchison ..... H01R 13/629 439/357
2015/0357758 A1 * 12/2015 Krietzman ..... H01R 13/639 439/345
2016/0365671 A1 12/2016 Stevens et al.

* cited by examiner

APPARATUS FOR PROVIDING POWER FOR MULTIPLE TYPES OF PLUGS VIA A SINGLE RECEPTACLE

CROSS REFERENCE TO RELATED APPLICATIONS

The present application claims the benefit under 35 U.S.C. § 119 of U.S. Provisional Patent Application Ser. No. 62/580,876 filed Nov. 2, 2017. The U.S. Provisional Patent Application Ser. No. 62/580,876 filed Nov. 2, 2017 is hereby incorporated by reference in its entirety.

TECHNICAL FIELD

The present disclosure generally relates to the field of electrical power distribution units, and more particularly to an apparatus for providing power for multiple types of plugs via a single receptacle.

BACKGROUND

Many electronic devices, particularly computer and data storage equipment, are supplied power from an alternating current (AC) power source. A power distribution unit (PDU) is typically employed with data storage equipment. A typical power distribution unit is usually formed as a long row of receptacles with a narrow width whereby equipment which requires electrical power may connect with the power distribution unit through the row of receptacles.

Conventional power distribution units have a number of challenges. Space is a premium within computer racks and cabinets; therefore, the size of the power distribution unit is always a major concern. As computer, server, and network equipment continues to grow in size, the concern over space within a computer rack or cabinet is increased. Also, there is a challenge with respect to a number of receptacles to provide on a power distribution unit, but there is also another challenge in the type of receptacles that should be placed on the power distribution unit to serve current requirements and future requirements.

SUMMARY

Accordingly, the present disclosure is directed to an apparatus for providing a multiple receptacle assembly whereby a number of receptacles could be configured within a single assembly of a standard size. It is contemplated that more receptacles may be available in a particular size and width than conventional power distribution units. Additionally, in another aspect of the present disclosure, the present disclosure is directed to an apparatus for providing power for multiple types of plugs via a single receptacle. In one embodiment of the disclosure, apparatus for providing power for multiple types of plugs via a single receptacle may provide power to one of a C14 plug or a C20 plug via a single receptacle, whereby the single receptacle may be configured to operate as a C13 and C19 receptacle and in compliance with IEC60320 standards.

It is to be understood that both the foregoing general description and the following detailed description are exemplary and explanatory only and are not necessarily restrictive of the present disclosure. The accompanying drawings, which are incorporated in and constitute a part of the specification, illustrate subject matter of the disclosure. Together, the descriptions and the drawings serve to explain the principles of the disclosure.

BRIEF DESCRIPTION OF THE DRAWINGS

The numerous advantages of the disclosure may be better understood by those skilled in the art by reference to the accompanying figures in which.

DETAILED DESCRIPTION

Reference will now be made in detail to the subject matter disclosed, which is illustrated in the accompanying drawings.

Before any embodiments of the disclosure are explained in detail, it is to be understood that the embodiments may not be limited in application per the details of the structure or the function as set forth in the following descriptions or illustrated in the figures. Different embodiments may be capable of being practiced or carried out in various ways. Also, it is to be understood that the phraseology and terminology used herein is for description and should not be regarded as limiting. The use of terms such as "including," "comprising," or "having" and variations thereof herein are generally meant to encompass the item listed thereafter and equivalents thereof as well as additional items. Further, unless otherwise noted, technical terms may be used according to conventional usage. It is further contemplated that like reference numbers may describe similar components and the equivalents thereof.

The present disclosure is directed to an apparatus for providing a multiple receptacle assembly whereby a number of receptacles could be configured within a single assembly of a standard size. It is contemplated that more receptacles may be available in a particular size and width than conventional power distribution units. Additionally, in another aspect of the present disclosure, the present disclosure is directed to an apparatus for providing power for multiple types of plugs via a single receptacle. In one embodiment of the disclosure, apparatus for providing power for multiple types of plugs via a single receptacle may provide power to one of a C14 plug or a C20 plug via a single receptacle, whereby the single receptacle may be configured to operate as a C13 and C19 receptacle and in compliance with IEC60320 standards.

Figure 1:
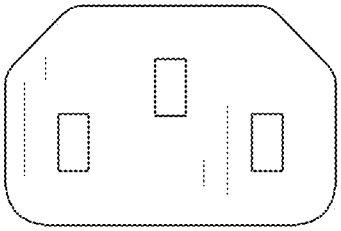
FIG. 1 depicts a front view of a C14 plug accordance with an embodiment of the present disclosure.
Figure 2:
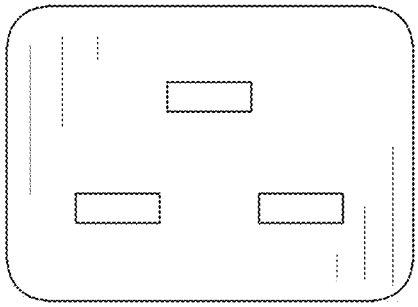
FIG. 2 depicts a front view of a C20 plug in accordance with an embodiment of the present disclosure.

Referring to FIG. 1, a front view of a C14 plug in accordance with an embodiment of the present disclosure is shown. In FIG. 2, a front view of a C20 plug in accordance with an embodiment of the present disclosure is shown. The C14 plug and C20 plug may refer to the male connectors according to two different standards of the IEC60320 standards which are commonly employed in computing appliances, servers, network devices, and the like.

Figure 3:
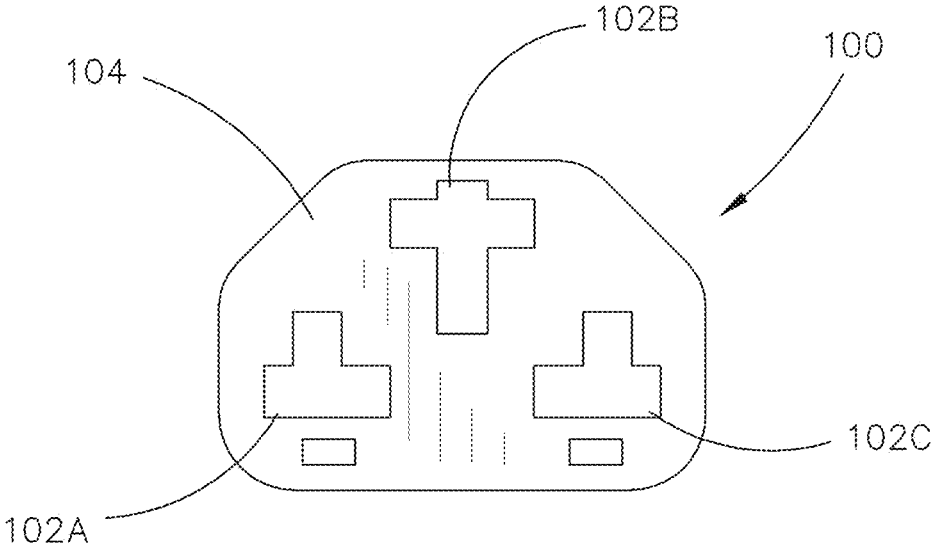
FIG. 3 depicts a front view of a receptacle configured to connect with one of a C14 plug or a C20 plug in accordance with an embodiment of the present disclosure.

Referring to FIG. 3, a front view of a receptacle configured to connect with one of a C14 plug or a C20 plug in accordance with an embodiment of the present disclosure is shown. For example, receptacle 100 may individually connect with a C14 plug or individually connect with a C20 plug. Receptacle 100 may include at least three electrical terminals 102A, 102B, 102C contained within a receptacle housing 104. The three electrical terminals 102A-102C are configured to connect with one of a C14 plug or a C20 plug wherein each electrical terminal of the at least three electrical terminals 102A-102C is configured to connect with a corresponding pin of a C14 plug or a pin of a C20 plug, despite the different size and orientation of the pins of the C14 plug and the pins of the C20 plug.

Figure 4:
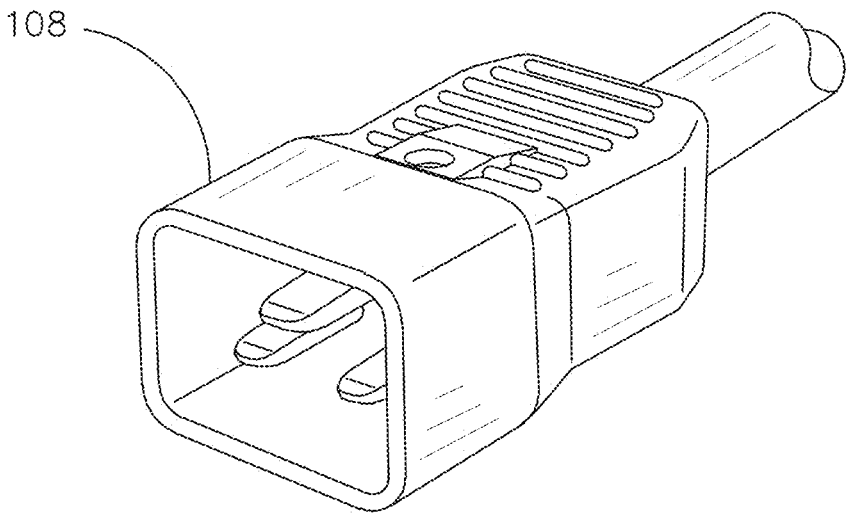
FIG. 4 depicts a perspective view of a C20 plug in accordance with an embodiment of the present disclosure.
Figure 5:
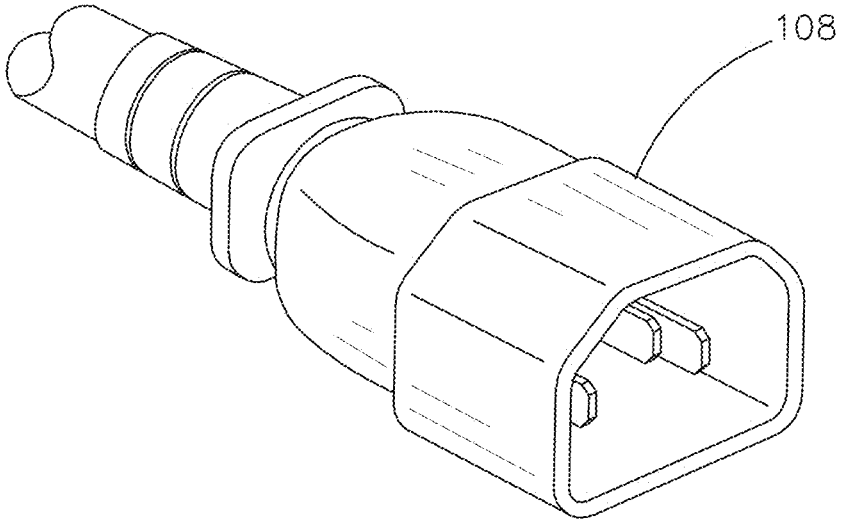
FIG. 5 depicts a perspective view of a C14 plug in accordance with an embodiment of the present disclosure.

Referring to FIG. 4, a perspective view of a C20 plug in accordance with an embodiment of the present disclosure is shown. FIG. 5 depicts a perspective view of a C14 plug in accordance with an embodiment of the present disclosure. Each of the C14 plug and C20 plug may include a shroud 108 which surrounds the pins of the respective plugs. It is contemplated that when the C14 plug or C20 plug is inserted within the receptacle 100, the shroud 108 would surround the receptacle 100 when the pins of the C14 plug or C20 plug are inserted within the terminals 102A-102C of the receptacle.

Figure 6:
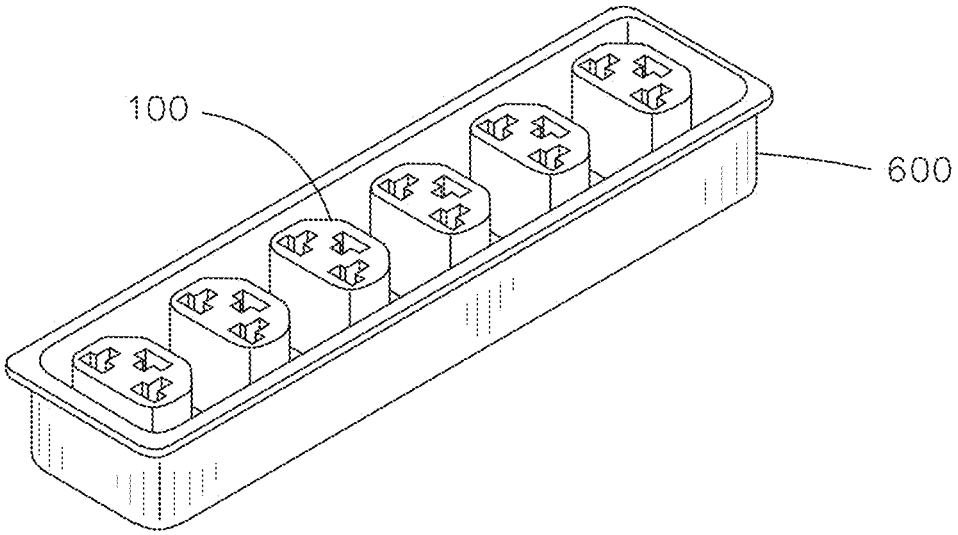
FIG. 6 depicts a multiple receptacle assembly whereby a number of receptacles may be configured within a single casing of a standard size in accordance with an embodiment of the present disclosure.

Referring to FIG. 6, a multiple receptacle assembly 600 whereby a number of receptacles may be configured within a single casing of a standard size in accordance with an embodiment of the present disclosure is shown. It is contemplated that six receptacles 100 may be included within the single casing of a multiple receptacle assembly 600. It is contemplated that casing may surround and may be formed with the receptacles whereby a locking mechanism may be employed with the casing. However, receptacles may be individually generated and may be formed with an individual receptacle assembly whereby a locking mechanism may be included with the receptacle assembly.

It is contemplated that the spacing/size of the receptacles may be arranged so that the number of receptacles on the power distribution unit may include one receptacle per rack unit (1 rack unit (RU)=44.45 mm=1.75"). As a result, a 42-receptacle power distribution unit may be produced with seven multiple receptacle assemblies 600 as shown in FIG. 6 whereby six receptacles may be placed within a single multiple receptacle assembly 600 of a size of 6 RU.

It is highly unlikely that a 42 RU cabinet has more than 42 individually pluggable pieces of equipment installed so a 42-receptacle power distribution unit would likely meet all current and future needs. Advantageously, as long as there were enough receptacles, it would not matter what type of C13 or C19 receptacles were needed because the number of receptacles of each type could be adjusted by a user of the equipment. Additionally, it is contemplated that the multiple receptacle assembly 600 may be presented in a 1 RU width. It is further contemplated that use of the multiple receptacle assembly 600 may allow alignment with same inter-connection points within the power distribution unit of an identical chassis to allow use of common internal printed circuit board assemblies and wiring schemas.

Figure 7:
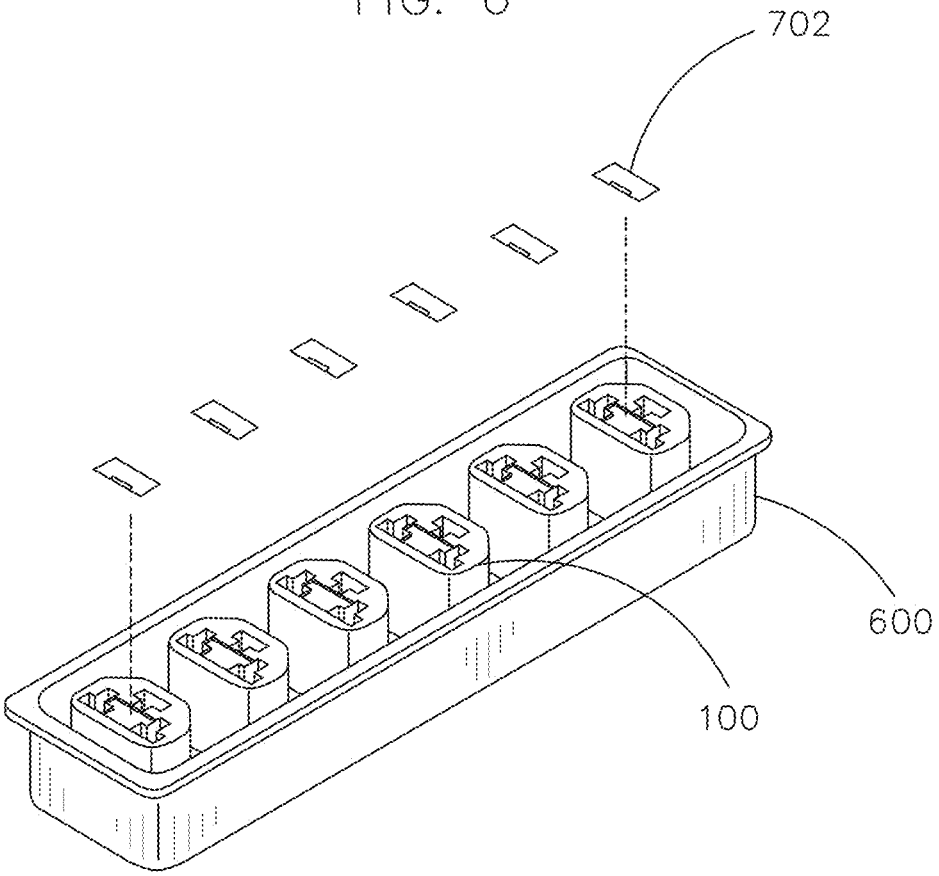
FIG. 7 depicts a multiple receptacle assembly with a tab that may be employed to limit a receptacle to be operable as a C13 receptacle.

Referring to FIG. 7, a multiple receptacle assembly 600 with a tab 702 that may be employed to limit a receptacle to be operable as a C13 receptacle is shown. In such a fashion, only a C14 plug may only be connectable with the receptacle. Based on user preference or to ensure compliance with regulatory requirements, a tab 702 may be optionally employed to ensure an either/or receptacle type but prevent multiple types of plugs being connectable with the receptacle 100. It is contemplated that the tab 702 may be a small plate of rigid material, such as plastic, and may be factory fitted and changed by an authorized user on site when a different receptacle type is needed with a specialized tool or key in accordance with an embodiment of the present disclosure.

Figure 8:
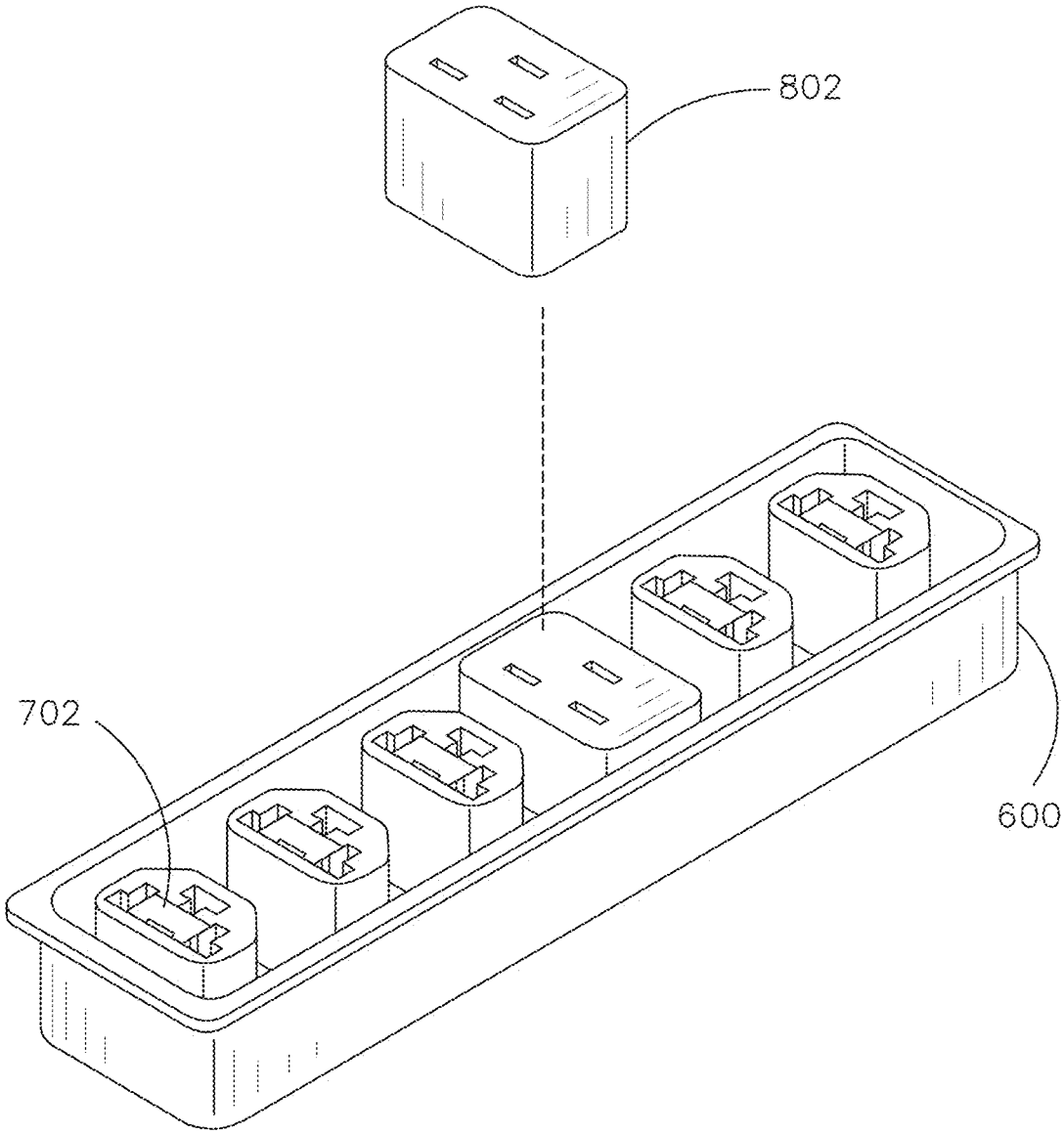
FIG. 8 depicts a multiple receptacle assembly with a cover that that may be employed to limit a receptacle to be operable as a C19 receptacle.

Referring to FIG. 8, a multiple receptacle assembly 600 with a cover 802 that may be employed to limit a receptacle to be operable as a C19 receptacle is shown. In such a fashion, only a C20 plug may be connectable with the receptacle. Cover 802 may be formed of rigid material, such as plastic, and may be optionally employed to surround the receptacle and only allow the receptacle to operate as a C19 receptacle. Cover 802 may be factory fitted and changed by an authorized user on site when a different receptacle type is needed with a specialized tool or key in accordance with an embodiment of the present disclosure. It should be understood that while a tab 702 may be employed to limit the receptacle to be operable as a C13 receptacle and a cover 802 may be employed to limit the receptacle to be operable as a C19 receptacle, it is contemplated that a tab may be formed to limit the receptacle to be operable as a C19 receptacle and a cover may be employed to limit the receptacle to be operable as a C13 receptacle.

Figure 9:
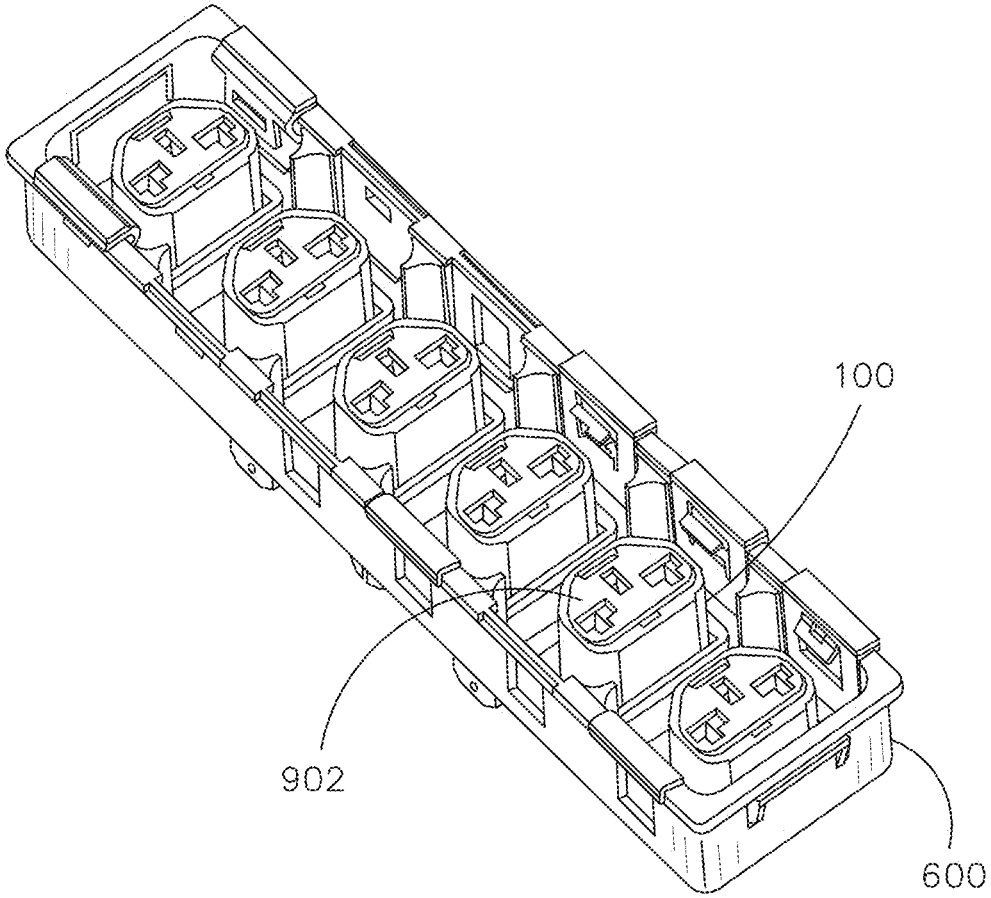
FIG. 9 depicts a multiple receptacle assembly with a slider mechanism which may be employed to limit a receptacle to be operable as one of a C13 or C19 receptacle.

Referring to FIG. 9, a multiple receptacle assembly 600 with a slider mechanism 902 which may be employed to limit a receptacle to be operable as one of a C13 or C19 receptacle is shown. It is contemplated that the slider mechanism 902 may be in a natural position whereby the receptacle is configured to operate only as a C13 receptacle and allows only a C14 plug to be inserted. If a user requires use of a C19 receptacle, by inserting a C20 plug, a ground safety pin of the C20 plug may move the slider mechanism 902 to a new position and expose the terminal apertures to allow only use as a C19 receptacle. Slider mechanism 902 may be formed of a rigid material and may include a spring mechanism, such as a spring, or the like, to allow movement across a receptacle.

Figure 10A:
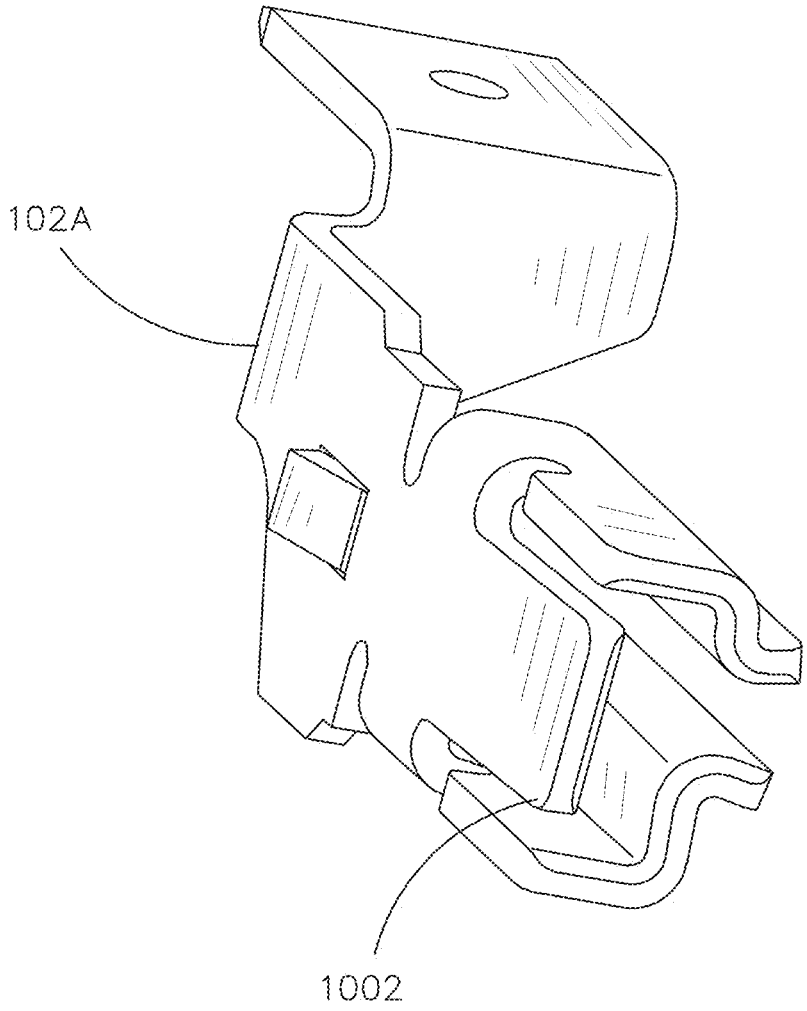
FIG. 10A-10C depict exemplary terminals of a receptacle in accordance with an embodiment of the present disclosure.
Figure 10B:
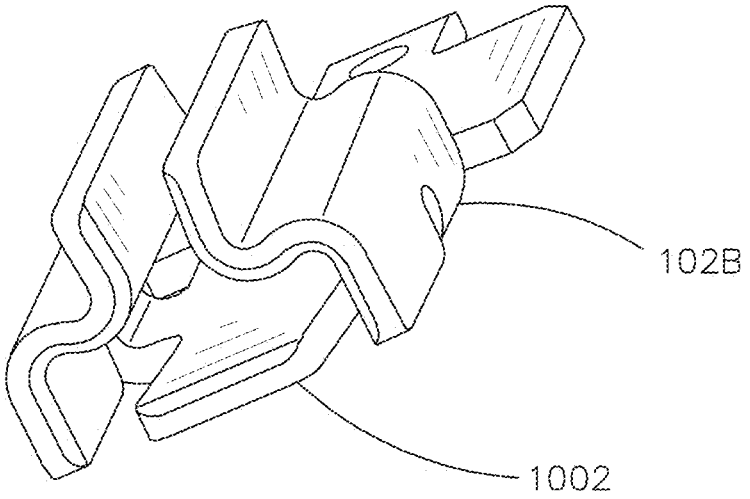
Figure 10C:
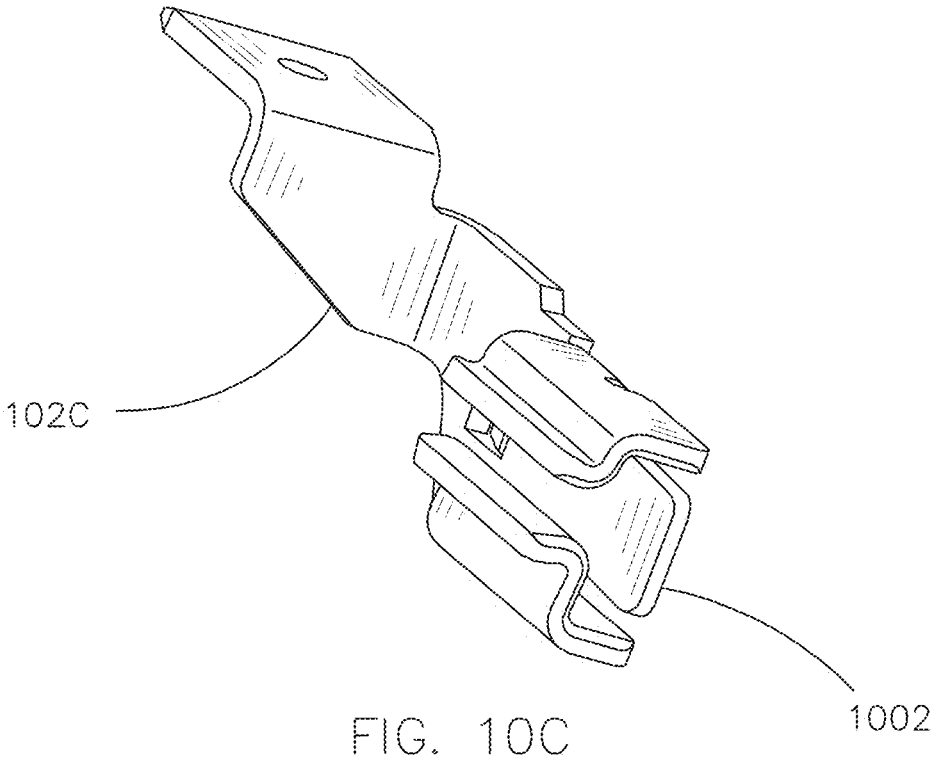

Referring to FIG. 10A-10C, exemplary terminals of a receptacle in accordance with an embodiment of the present disclosure are shown. Terminals 102A, 102B, and 102C may be commoned between both the C13 and C19 terminal design. It is contemplated that terminal 102A may be a neutral terminal, terminal 102B may be an earth terminal, and terminal 102C may be a live terminal. It is contemplated that the C19 terminal may connect with a pin of a C20 plug in a generally horizontal plane as shown in FIG. 10B whereby a plane of the C20 plug pin may be on top of flexible contact member 1002. It is contemplated that the C13 terminal may connect with a pin of the C14 plug in a generally vertical plane whereby an edge of the pin of the C14 plug may be on top of the flexible contact member 1002. Terminals 102A-102C may each include a flexible contact member 1002 which may be pre-stressed or include a spring mechanism to ensure contact may be maintained with a pin from a C14 plug or a C20 plug by providing a force toward an interior of the terminal.

Figure 11A:
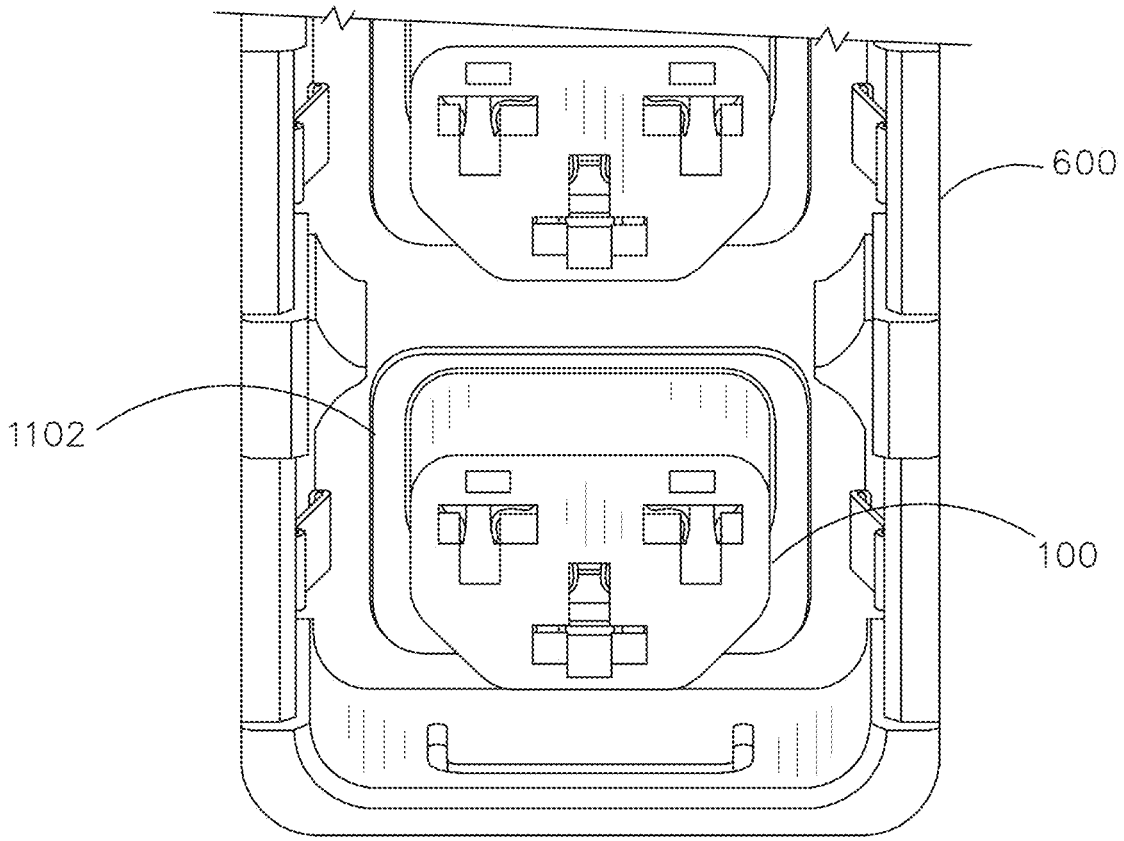
FIG. 11A-11B depict a receptacle in accordance with an embodiment of the present disclosure.
Figure 11B:
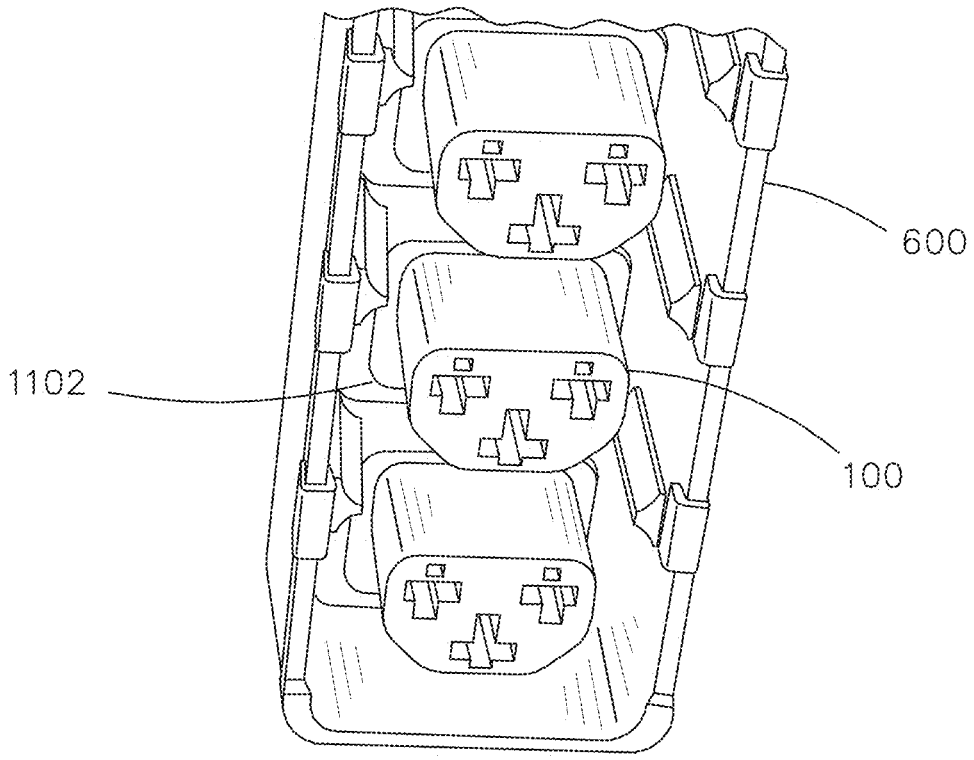

Referring to FIG. 11A-11B, a receptacle assembly in accordance with an embodiment of the present disclosure is shown. Receptacle assembly may include a receptacle 100 and may include a flange 1102. Flange 1102 may include a projecting rim or collar that may surround a receptacle 100 at the base of the receptacle housing. It is contemplated that the flange 1102 may be employed to provide a more secure fit between the receptacle housing and one of the C14 plug or the C20 plug.

As described previously with respect to FIG. 4 and FIG. 5, each of the C14 plug and the C20 plug may include a shroud 108 which surrounds the pins of the respective plugs. It is contemplated that when the C14 plug or C20 plug is inserted within the receptacle 100, the shroud 108 would surround the receptacle 100 when the pins of the C14 plug or C20 plug are inserted within the terminals 102A-102C of the receptacle 100. Flange 1102 may be formed and sized whereby the shroud 108 of a C20 plug may surround the flange 1102 of the receptacle housing and provide a tension fit at the base of the receptacle housing. For example, an interior diameter of the shroud of the C20 plug may be just slightly larger than an exterior diameter of the flange 1102 so that a tension fit between the shroud 108 and the flange 1102 may be formed. This is shown in an exemplary fashion in FIG. 13A. Additionally, a shroud 108 of the C14 plug may connect with a top side of the flange 1102 and may account for a difference in size between the C14 plug and a C20 plug. For example, a height of the flange may be sized in order to allow an exterior edge of the shroud 108 of a C14 plug to contact and rest upon a top side of flange 1102. This is shown in an exemplary fashion in FIG. 13B. Advantageously, flange 1102 may allow a more secure fit between receptacle 100 to one of a C14 plug or a C20 plug, without a requirement of a locking mechanism.

Figure 12A:
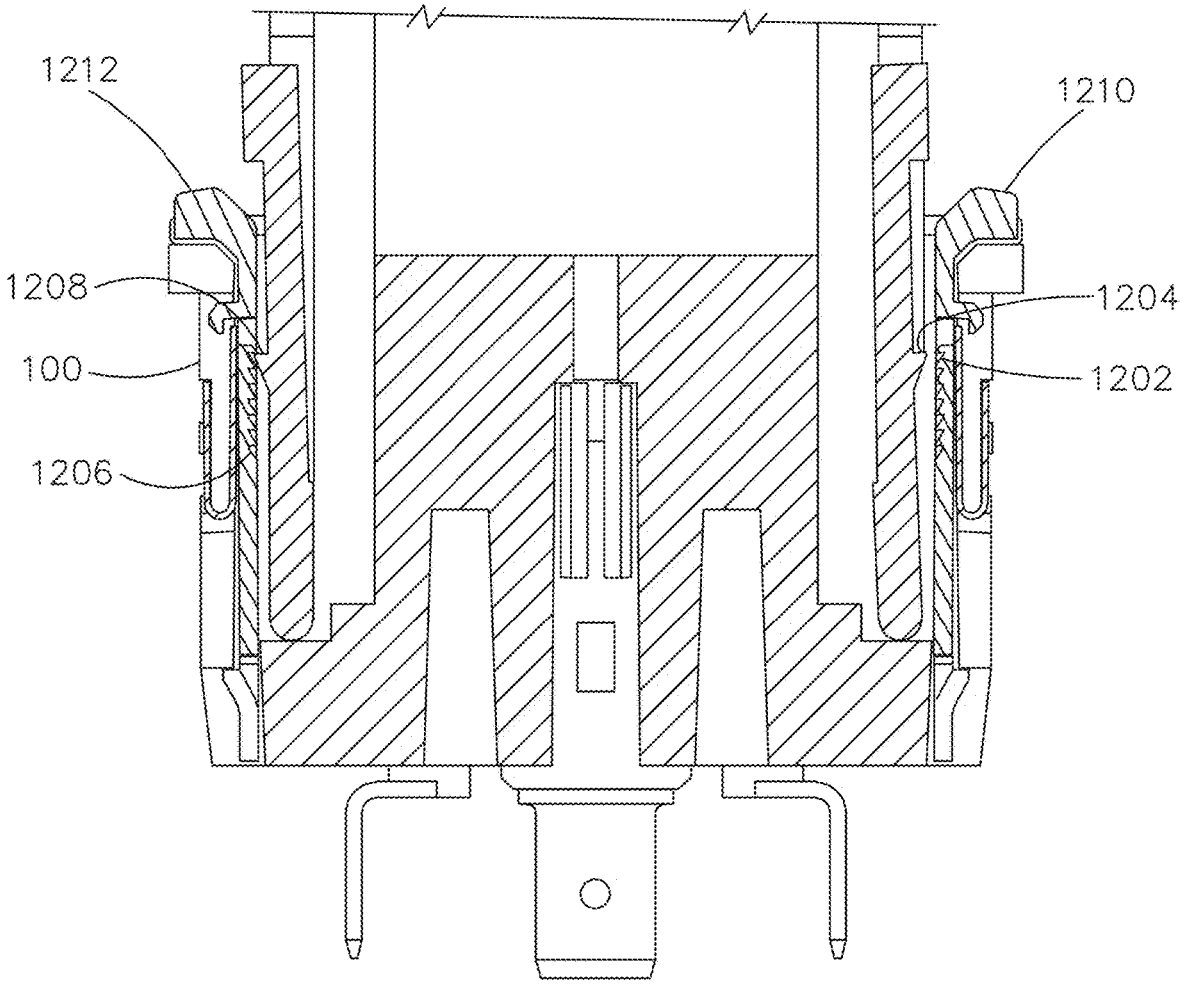
FIG. 12A-12B depict a receptacle assembly which includes a locking mechanism in accordance with an embodiment of the present disclosure.
Figure 12B:
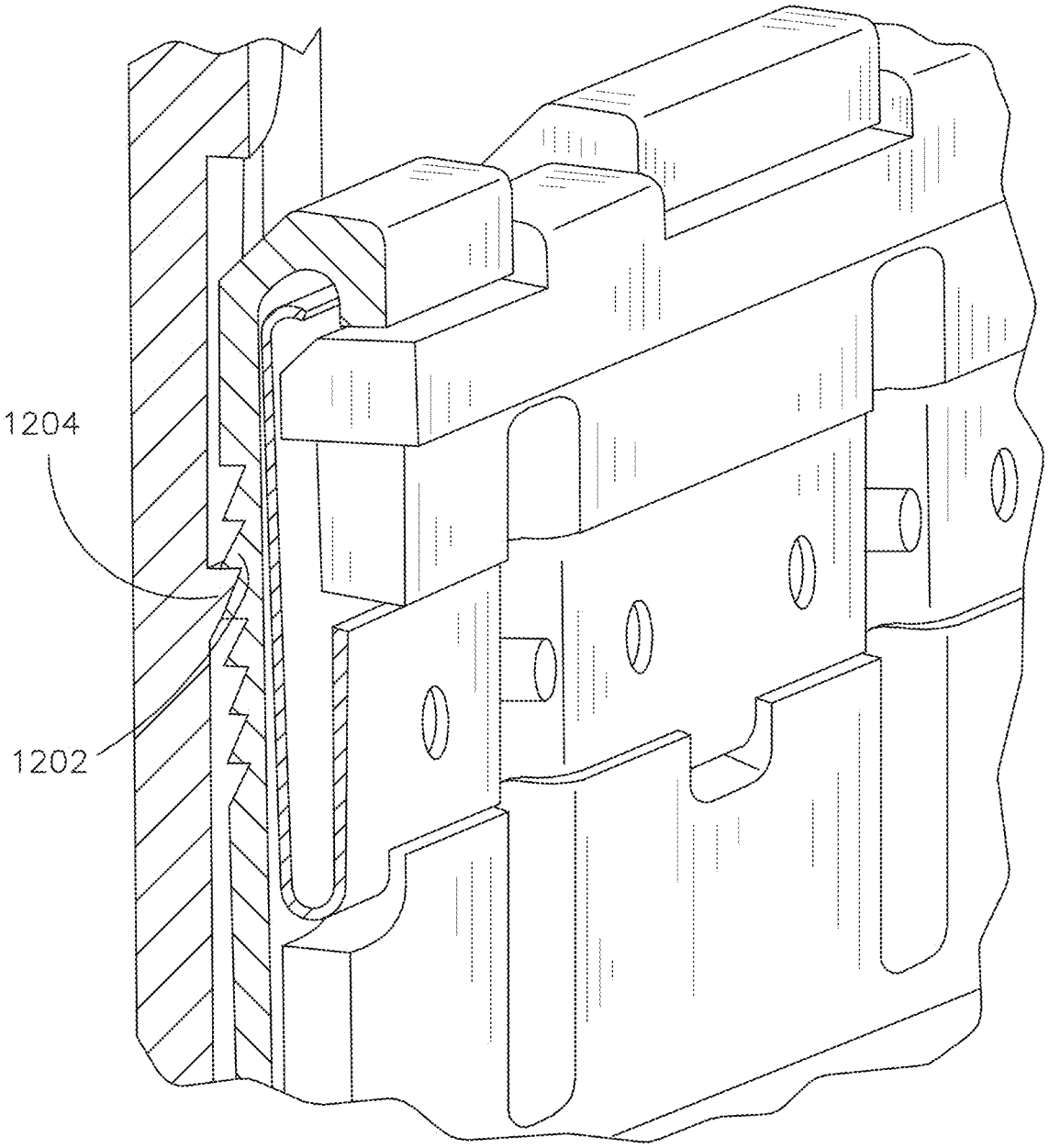

Referring to FIG. 12A-12B, a receptacle assembly which includes a locking mechanism in accordance with an embodiment of the present disclosure is shown. It is contemplated that a plug, such as a C14 plug or C20 plug, may be prevented from unintended disconnection from the receptacle through employment of a locking mechanism. Locking mechanism may be formed as part of a P Lock locking mechanism whereby a specialized plug, referred as a P Lock plug, may be employed. A ridge 1204, 1208 on opposing sides of a plug may come into contact with a ledge 1202, 1206 on opposing sides of a receptacle assembly or casing of a multiple receptacle assembly 600. It is contemplated that a plurality of ledges at varying heights may be provided with the locking mechanism which is shown in an exemplary fashion in FIG. 12B with a plurality of ledges. Arms 1210, 1212 are configured to be directed away from the receptacle to release ridges 1204, 1208 of a plug from ledges 1202, 1206 of the locking mechanism of the receptacle assembly or casing, at which point the plug may be released and disconnected from the receptacle. FIG. 12B depicts an exploded view of a receptacle assembly which includes a locking mechanism.

Figure 13A:
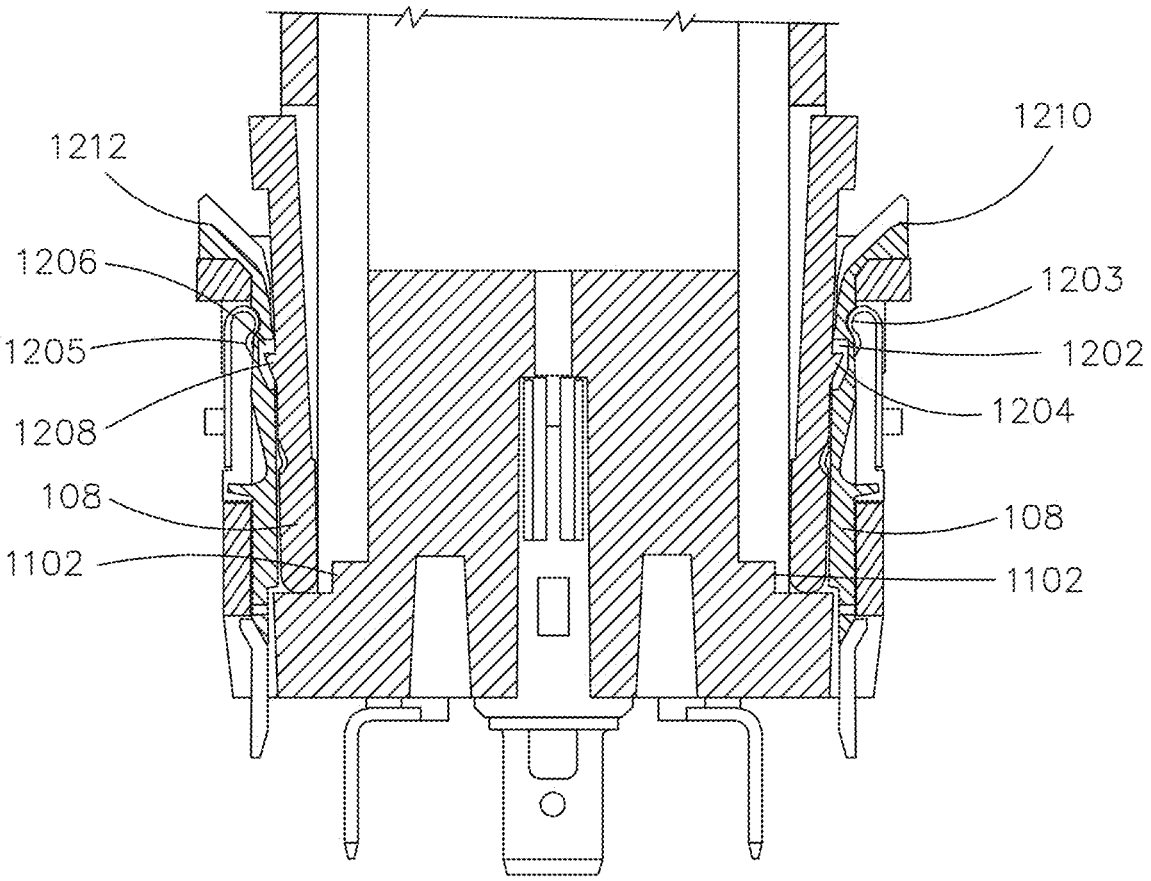
FIG. 13A-13B depict a receptacle assembly which includes a locking mechanism which is operable with one of a C20 plug or a C14 plug in accordance with an embodiment of the present disclosure.
Figure 13B:
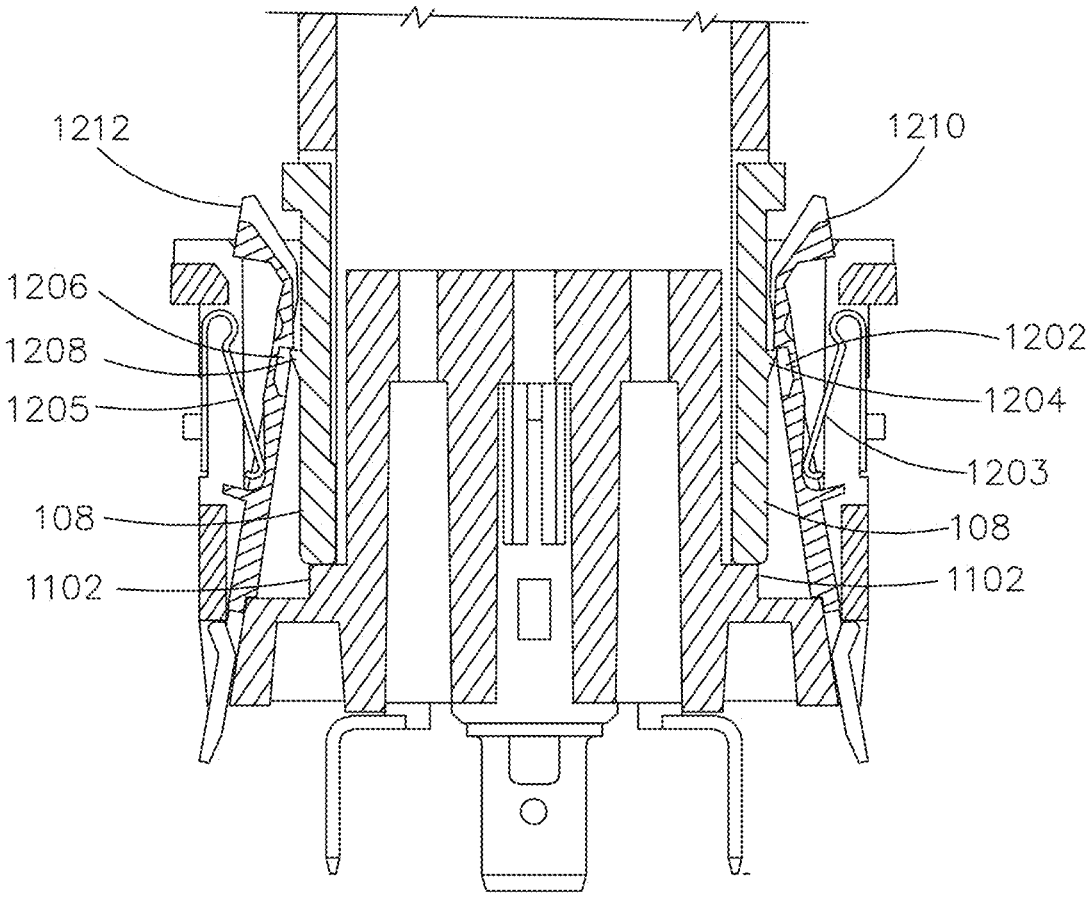

Referring to FIG. 13A-13B, a receptacle assembly which includes a locking mechanism which is operable with one of C20 plug or a C14 plug in accordance with an embodiment of the present disclosure is shown. FIG. 13A depicts a C20 plug and FIG. 13B depicts a C14 plug. Advantageously, despite the difference in size of the shroud 108 of a C20 plug and a C14 plug, one of a C20 plug or C14 plug may be retained within a receptacle through the locking mechanism as employed in FIG. 13A-13B.

Ridge 1204, 1208 on opposing sides of a C20 plug or C14 plug may come into contact with a ledge 1202, 1206 on opposing sides of a receptacle assembly or casing of a multiple receptacle assembly 600. It is contemplated that a plurality of ledges at varying heights may be provided as part of the locking mechanism which is shown in an exemplary fashion in FIG. 12B with a plurality of ledges. Arms 1210, 1212 may be configured to be directed away from the receptacle to release ridges 1204, 1208 of a plug from ledges 1202, 1206 of the locking mechanism of the receptacle assembly, at which point the plug may be released and disconnected from the receptacle. It is contemplated that the locking mechanism may be employed with one of a C20 plug or a C14 plug despite their sizes differences due to spring mechanism 1203, 1205 on each side of the receptacle assembly or casing. Spring mechanism 1203, 1205 may force arms 1210, 1212 toward the plug and will account for the difference in sizes between the C20 plug and C14 plug. Spring mechanism 1203, 1205 may include any elastic object that stores mechanical energy. Spring mechanism 1203, 1205 may include a helical or conical compression spring, a pre-stressed lever, spring clip, and the like.

FIG. 13A and FIG. 13B also depict the flange 1102 and shroud 108 of a C20 plug in FIG. 13A and a C14 plug in FIG. 13B. For example, an interior diameter of the shroud 108 of the C20 plug may be just slightly larger than the exterior diameter of the flange 1102 so that a tension fit between the shroud 108 and the flange 1102 may be formed. Additionally, a shroud 108 of the C14 plug may connect with a top side of the flange 1102 and may account for a difference in size between the C14 plug and a C20 plug. For example, a height of the flange may be sized in order to allow an exterior edge of the shroud 108 of a C14 plug to contact and rest upon a top side of flange 1102.

Figure 14A:
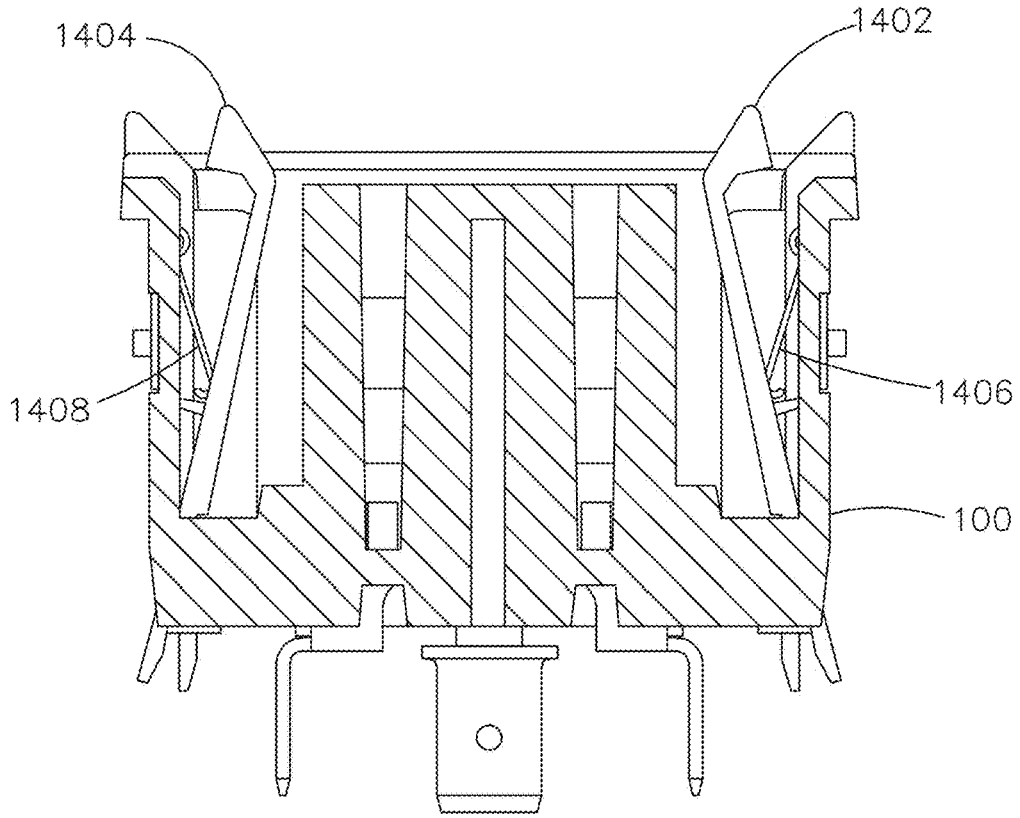
FIG. 14A-14B depict a receptacle assembly which includes a locking mechanism in accordance with an alternative embodiment of the present disclosure.
Figure 14B:
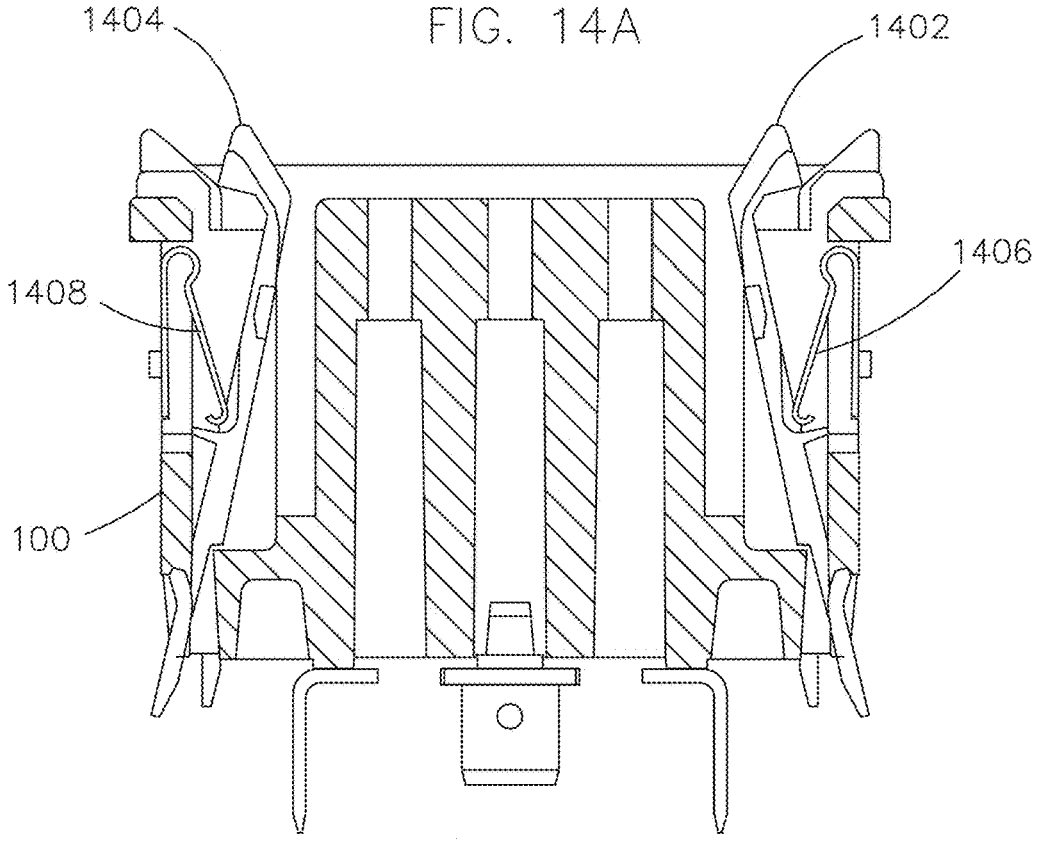

Referring to FIG. 14A-14B, a receptacle assembly which includes a locking mechanism in accordance with an alternative embodiment of the present disclosure is shown. As shown in FIG. 14A, locking mechanism may be operable with a C20 plug and as shown in FIG. 14B, locking mechanism may be operable with a C14 plug. Locking mechanism may include an interference fit or contact fit to prevent unintended disconnection of a plug from a receptacle. A spring mechanism 1406, 1408 may force arms 1402, 1404 toward the plug to provide an interference fit or contact fit and prevent unintended disconnection of a plug from the receptacle. Spring mechanism 1406, 1408 may include any elastic object that stores mechanical energy. Spring mechanism 1203, 1205 may include a helical or conical compression spring, a pre-stressed lever, spring clip, and the like.

A plug may be released when arms 1402, 1404, configured to be depressed outwardly from the receptacle assembly or a casing of a multiple receptacle assembly, to release the interference fit or contact fit, at which point the plug may be disconnected and released from the receptacle. While there are two arms shown, it is contemplated that one, three, or four or more arms may be employed without departing from the scope and intent of the present disclosure.

Receptacle assembly or casing and arms 1402, 1404 may be formed of a variety of rigid materials, including plastic, an elastomer material, composites and metals. It is contemplated that plastic may be engineering grade and the plastic may follow local safety requirements. The elastomer material may form a grip for a friction fit with the shroud of a plug as an elastomer material may be softer and slightly compressible to allow a friction fit with a shroud of a plug. The elastomer material may be a thermoplastic elastomer (TPE) material. Additionally, the elastomer material may be acrylonitrile butadiene, styrene, polycarbonate, polyethylene, or polypropylene.

In an embodiment, arms 1402, 1404 may each include a barb at the portion of the arm which contacts the plug. Barb may refer to a projection extending from each arm which is configured to contact the shroud of a plug. It is contemplated that the plug may be retained within the receptacle assembly by pressure applied by the at least one arm and barb, which may be referred as an interference fit or contact fit. Barb may include an angled and sharp edge directed toward the shroud 108 of a plug, and may be formed of plastic or metal.

It is contemplated that the locking mechanism of FIG. 14A-14B may be operable with IEC 60320 couplers, referring to a list of standards from the International Electrotechnical Commission specifying non-locking appliance couplers and interconnection couplers for the connection of power supply cords to electrical appliances up to 250 Volts, including C13, C15, C19 and C21 receptacles. Additionally, it is contemplated that the locking apparatus of FIG. 14A-14B may be operable with any type of plug that includes a shroud that may cover at least a portion of the pins of the plug without a requirement of specialized plugs, and thus may be referred as a universal locking mechanism.

In an advantageous aspect of the present disclosure, one or more arms 1402, 1404 may be retained within an interior portion of the receptacle assembly or casing of a multiple receptacle assembly. Conventional devices to retain plugs may include pins and the like which secure to the plug on the exterior or outside of the receptacle. However, such an arrangement reduces the number of receptacles that may be placed in a given area and makes insertion and removal of a plug more difficult as the pins and the like must be accounted for by a user during insertion of the plug and removal of the plug.

Figure 15:
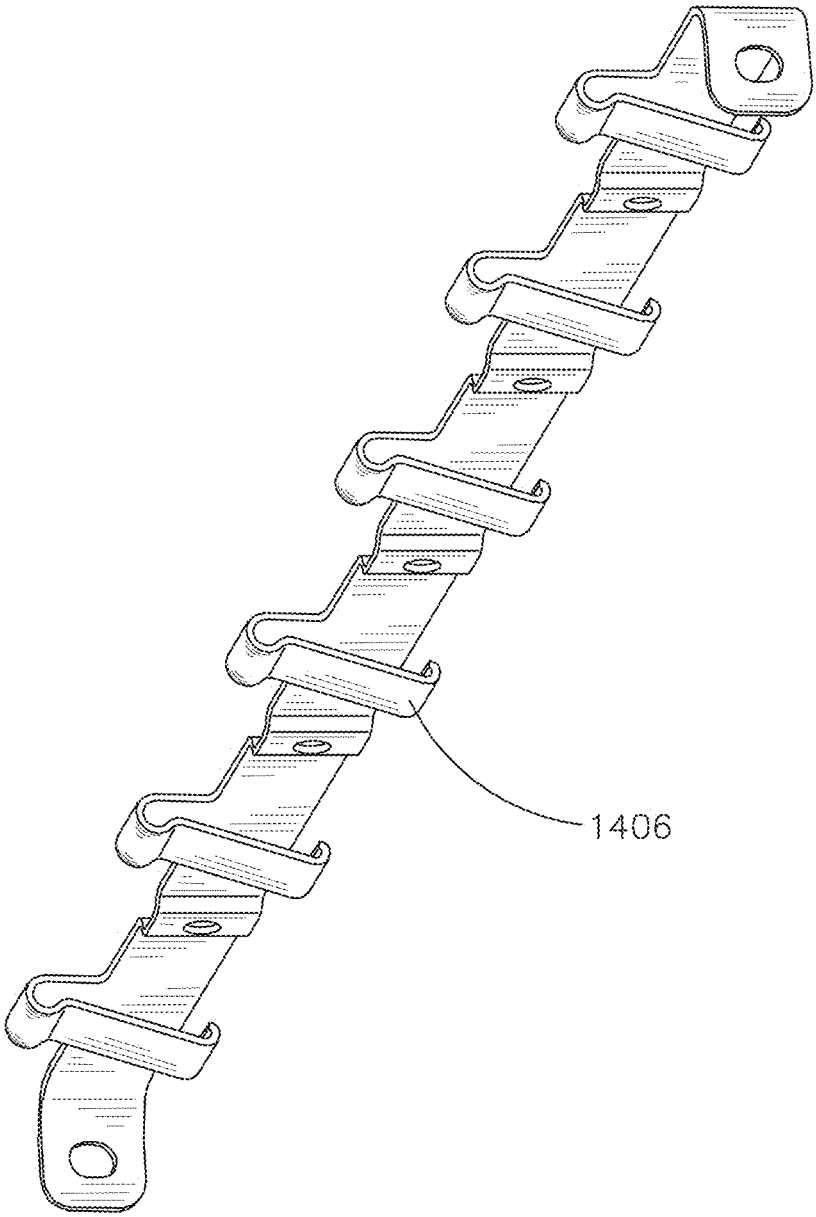
FIG. 15 depicts a spring assembly for creating locking mechanisms for receptacles of a multiple receptacle assembly in accordance with an embodiment of the present disclosure.

Referring to FIG. 15, a spring assembly for creating locking mechanisms for receptacles of a casing of a multiple receptacle assembly in accordance with an embodiment of the present disclosure is shown. It is contemplated that a multiple spring mechanism system may be formed of metal and may connect to a casing to provide multiple spring mechanisms 1406 as described in FIG. 14A-14B, and also may provide a plurality of spring mechanisms 1203, 1205 as depicted in FIG. 13A-13B in order to operate with a multiple receptacle assembly.

It is contemplated that receptacle 100 may provide a fully rated C13/19 combination receptacle assembly and may be formed with ganged earth, fully 16/20 A rated receptacles which are finger safe in compliance with IEC60320. It is contemplated that live (hot) and neutral connections to the receptacle 100 may be ganged as a single line and neutral or kept as individual connections to allow for total wiring flexibility.

It is believed that the present disclosure and many of its attendant advantages will be understood by the foregoing description, and it will be apparent that various changes may be made in the form, construction and arrangement of the components without departing from the disclosed subject matter or without sacrificing all of its material advantages. The form described is merely explanatory, and it is the intention of the following claims to encompass and include such changes.

What is claimed is:

1. A receptacle assembly, comprising:

a receptacle, the receptacle including at least three electrical terminals contained within a receptacle housing, wherein the at least three electrical terminals of the receptacle are configured to connect with one plug of multiple types of plugs, the multiple types of plugs including a C14 plug and a C20 plug, the receptacle housing including a flange at a base of the receptacle housing to provide a more secure fit between the receptacle housing and one plug of multiple types of plugs, the multiple types of plugs including the C14 plug and the C20 plug.

2. The receptacle assembly of claim 1, wherein a shroud of the C20 plug surrounds the flange of the receptacle housing.

3. The receptacle assembly of claim 1, wherein an exterior edge of a shroud of the C14 plug connects with a top side of the flange of the receptacle housing.

4. The receptacle assembly of claim 1, wherein the receptacle housing further includes at least one of a tab, a slider mechanism, or a cover which is configured to limit the receptacle to connect with one plug of multiple types of plugs, the multiple types of plugs including the C14 plug and the C20 plug.

5. The receptacle assembly of claim 1, wherein each electrical terminal of the at least three electrical terminals is configured to connect with one of a pin of one of the C14 plug or a pin of the C20 plug.

6. The receptacle assembly of claim 5, wherein each electrical terminal of the at least three electrical terminals includes a flexible contact member to ensure an electrical connection with one of the pin of the C14 plug or the pin of the C20 plug.

7. A receptacle assembly, comprising:

a receptacle, the receptacle including at least three electrical terminals contained within a receptacle housing, wherein the at least three electrical terminals of the receptacle are configured to connect with one plug of multiple types of plugs, the multiple types of plugs including a C14 plug and a C20 plug.

8. The receptacle assembly of claim 7, wherein the receptacle housing includes a flange at a base of the receptacle housing.

9. The receptacle assembly of claim 8, wherein the flange is configured to provide a more secure fit between the receptacle housing and one plug of multiple types of plugs, the multiple types of plugs including the C14 plug and the C20 plug.

10. The receptacle assembly of claim 9, wherein a shroud of the C20 plug surrounds the flange of the receptacle housing.

11. The receptacle assembly of claim 9, wherein an exterior edge of a shroud of the C14 plug connects with a top side of the flange of the receptacle housing.

12. The receptacle assembly of claim 7, wherein the receptacle housing further includes at least one of a tab, a slider mechanism, or a cover which is configured to limit the receptacle to connect with only one plug of multiple types of plugs, the multiple types of plugs including the C14 plug and the C20 plug.

13. The receptacle assembly of claim 7, wherein each electrical terminal of the at least three electrical terminals includes a flexible contact member to ensure an electrical connection with one of a pin of the C14 plug or a pin of the C20 plug.

14. A multiple receptacle assembly, comprising:

a casing; and a plurality of receptacles which are assembled at least partially within the casing, each receptacle of the plurality of receptacles including at least three electrical terminals contained within a receptacle housing, wherein the at least three electrical terminals of each receptacle are configured to connect with one plug of multiple types of plugs, the multiple types of plugs including a C14 plug and a C20 plug, the receptacle housing including a flange at a base of the receptacle housing to provide a more secure fit between the receptacle housing and one plug of multiple types of plugs, the multiple types of plugs including the C14 plug and the C20 plug.

15. The multiple receptacle assembly of claim 14, wherein a shroud of the C20 plug surrounds the flange of the receptacle housing.

16. The multiple receptacle assembly of claim 14, wherein an exterior edge of a shroud of the C14 plug connects with a top side of the flange of the receptacle housing.

17. The multiple receptacle assembly of claim 14, wherein the receptacle housing further includes at least one of a tab, a slider mechanism, or a cover which is configured to limit the receptacle to connect with only one plug of multiple types of plugs, the multiple types of plugs including the C14 plug and the C20 plug.

18. The multiple receptacle assembly of claim 14, wherein each electrical terminal of the at least three electrical terminals is configured to connect with one of a pin of the C14 plug or a pin of the C20 plug.

19. The multiple receptacle assembly of claim 18, wherein each electrical terminal of the at least three electrical terminals includes a flexible contact member to ensure an electrical connection with one of the pin of the C14 plug or the pin of the C20 plug.

20. The multiple receptacle assembly of claim 14, wherein the casing further includes a locking mechanism configured to secure one plug of multiple types of plugs, the multiple types of plugs including the C14 plug and the C20 plug to a receptacle of the plurality of receptacles.

21. The multiple receptacle assembly of claim 20, wherein the locking mechanism includes at least two arms forced toward the receptacle via a spring mechanism for each arm of the at least two arms.

22. The multiple receptacle assembly of claim 21, wherein the arms are configured to be directed away from the receptacle in order to release the one plug of multiple types of plugs, the multiple types of plugs including the C14 plug and the C20 plug.

* * * * *